US005826781A

United States Patent [19]

Jensen

[11] Patent Number: 5,826,781

[45] Date of Patent: Oct. 27, 1998

[54] IDENTIFICATION BUTTON FOR PAPERBOARD CONTAINER

[75] Inventor: Kurt D. Jensen, Lebanon, Ohio

[73] Assignee: International Paper Company, Purchase, N.Y.

[21] Appl. No.: 883,426

[22] Filed: Jun. 26, 1997

[51] Int. Cl.[6] ..... B65P 5/42

[52] U.S. Cl. ..... 229/114; 206/459.1; 229/116.1; 229/902

[58] Field of Search ..... 229/114, 116.1, 229/902, 906; 40/312; 206/459.1, 459.5

[56] References Cited

U.S. PATENT DOCUMENTS

| | | | |
|---|---|---|---|
| Re. 33,979 | 6/1992 | Cortopassi | 206/459.1 |
| 3,205,603 | 9/1965 | Brumley | 40/312 |
| 3,974,916 | 8/1976 | Bartolucci | 206/459.1 |
| 4,472,896 | 9/1984 | Brauner et al. | 229/902 |
| 4,805,775 | 2/1989 | Fear | 206/459.1 |
| 5,388,758 | 2/1995 | Scovell | 229/114 |
| 5,690,273 | 11/1997 | Jensen | 229/116.1 |

*Primary Examiner*—Gary E. Elkins

*Attorney, Agent, or Firm*—Christopher Nicastri; Michael J. Doyle

[57] ABSTRACT

An identification button construction for a paperboard clamshell carton or container. An edge of the carton lid, such as a horizontal edge, is provided with a plurality of cuts or scores which form the periphery of individual identification buttons. Such buttons are used to indicate the presence or absence of an ingredient or garnish for a hot food item such as a hamburger sandwich. The peripheral scores or lines of the button are cut about half way through the paperboard from the outer carton surface towards the carton interior. An elongated Z shaped cut, completely through the paperboard, bisects the button, at a right angle to the crown edge. The crown edge also bisects the button. While a diamond shape button is illustrated, round, oval, or other polygonal shapes may be employed. In use, a button is finger pressed toward the carton interior and assumes a depressed configuration, different from its original configuration, thus indicating the presence or absence of a garnish or other ingredient for the packaged food item.

9 Claims, 2 Drawing Sheets

IDENTIFICATION BUTTON FOR PAPERBOARD CONTAINER

BACKGROUND OF THE INVENTION

This invention relates to food containers and more particularly to a clamshell type paperboard container particularly adapted for serving hamburgers or other food items at fast food outlets. Clamshell containers, fashioned from either a foamed plastic or from paperboard, have been known for some time and enjoy wide popularity in packaging fast food products. Typically, a clamshell type container includes a base or tray portion having a rear wall, with a top or lid portion also having a rear wall, with these two rear walls being integrally joined. After the food item is placed into the tray, the lid portion is swung forwardly and latched to a releasable position relatively easily reopened when the consumer wishes to obtain access to the food item.

There exists a need, in the field of paperboard containers for packaging fast foods, for a simple and reliable technique whereby the server of the food items can indicate on the container which of several ingredients or garnishes have either been placed with the food product or have been omitted from it. This need exists Along with the requirement that the indication technique be a part of the carton and that it be simple and foolproof.

SUMMARY OF THE INVENTION

According to the practice of this invention, a clamshell type container fashioned of paperboard or other stiff, resilient, and foldable sheet material, is provided with one or more indicator buttons along a top horizontal front edge of the crown of the container. The buttons are each in the general form of a diamond whose sides are defined by partial cuts through the paperboard, the direction of the cuts being from the outer or exterior carton surface towards the carton interior. The diamond shaped indicator button is bisected by the horizontal front edge fold of the lid. A cut line, completely through the paperboard, bisects and extends across the width of the indicator button, and runs at right angles to the horizontal front edge fold line.

In use, after the hamburger or other food product has been placed into the clamshell base and the lid is swung into its latched position, the server may push one or more of the indicator buttons to thereby more or less permanently deform it from its original configuration, thus indicating to the consumer which garnish or ingredient has been either omitted from or included in the food product. For this purpose suitable indicia may be printed adjacent each button.

DETAILED DESCRIPTION OF THE INVENTION

Figure 1:
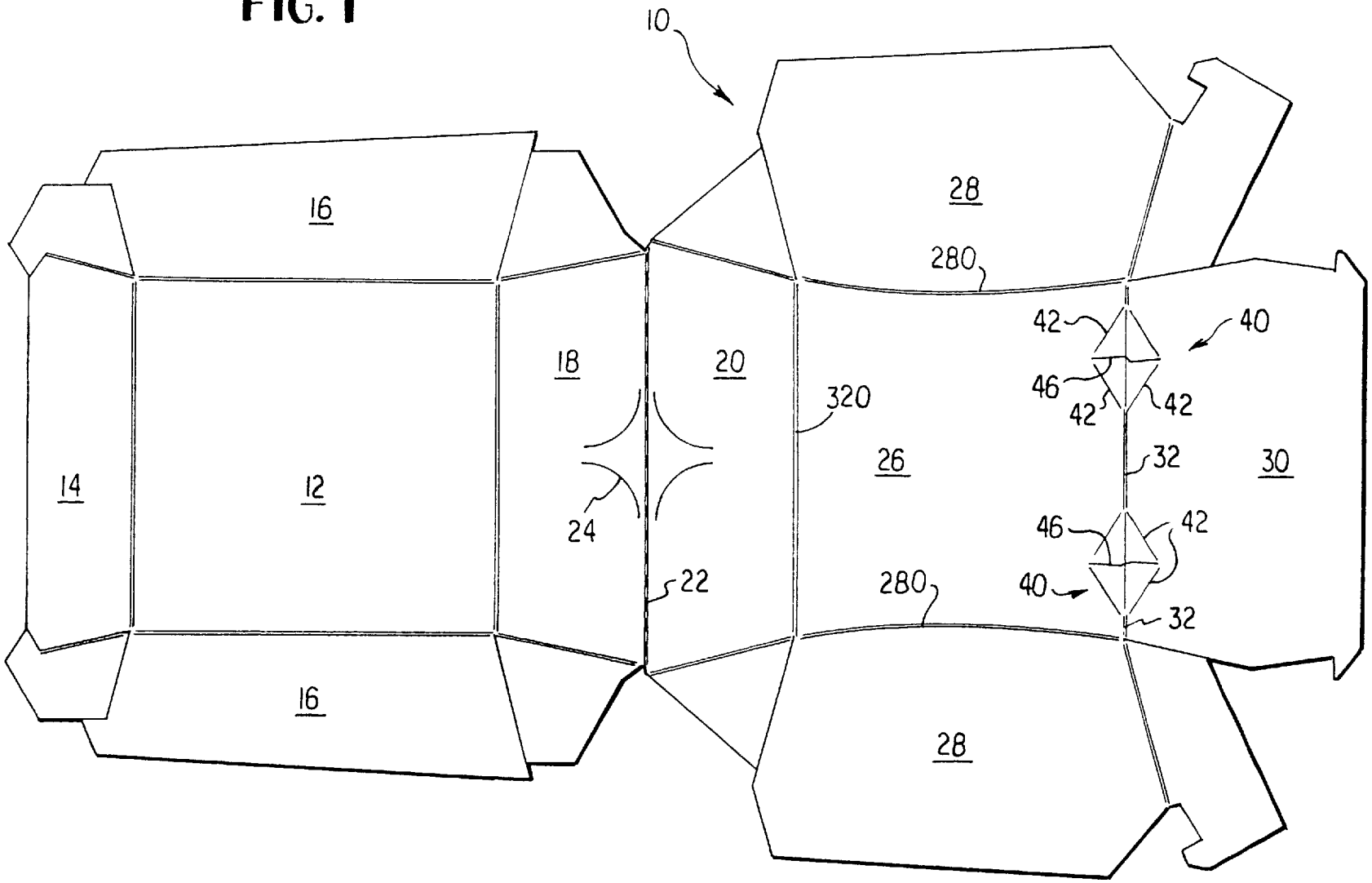
FIG. 1 is a plan view of a unitary blank of paperboard for forming a clamshell type carton or container which includes the identification button construction according to this invention.

Referring now to FIG. 1, a unitary blank 10 of paperboard is cut and scored as indicated. Blank 10 is generally rectangular in configuration, and includes a left portion which forms a tray and a right portion which forms a lid, the tray and lid being integrally hinged together along respective rear tray and lid walls. The bottom panel of the tray is designated as 12, with the front wall of the tray designated as 14. Two tray side walls 16 are also integrally folded to base or bottom panel 12, while rear tray wall 18 is foldably and integrally connected to tray bottom panel 12. The right hand portion of blank 10 includes a lid forming portion, the rear wall of the lid designated as 20, with a fold line 22 between panels 18 and 20, panels 18 and 20 being essentially a unitary panel. Arcuate cut 24 denotes any one of optional, anti-buckling cuts through panels 18 and 20. Such cuts are known in the container field and form no part of this invention.

Panel 26 forms the top panel of the crown, the crown having side walls 28, connected to panel 26 by the indicated curved fold lines 280, while 30 denotes the front forward panel of the crown. Fold line 32 connects panels 26 and 30, while opposite fold line 320 connects crown rear wall 20 to crown top panel 26.

The remaining portions of the blank, not specifically numbered, represent glue tabs and a latching arrangement, neither of which form any part of this invention.

Figure 2:
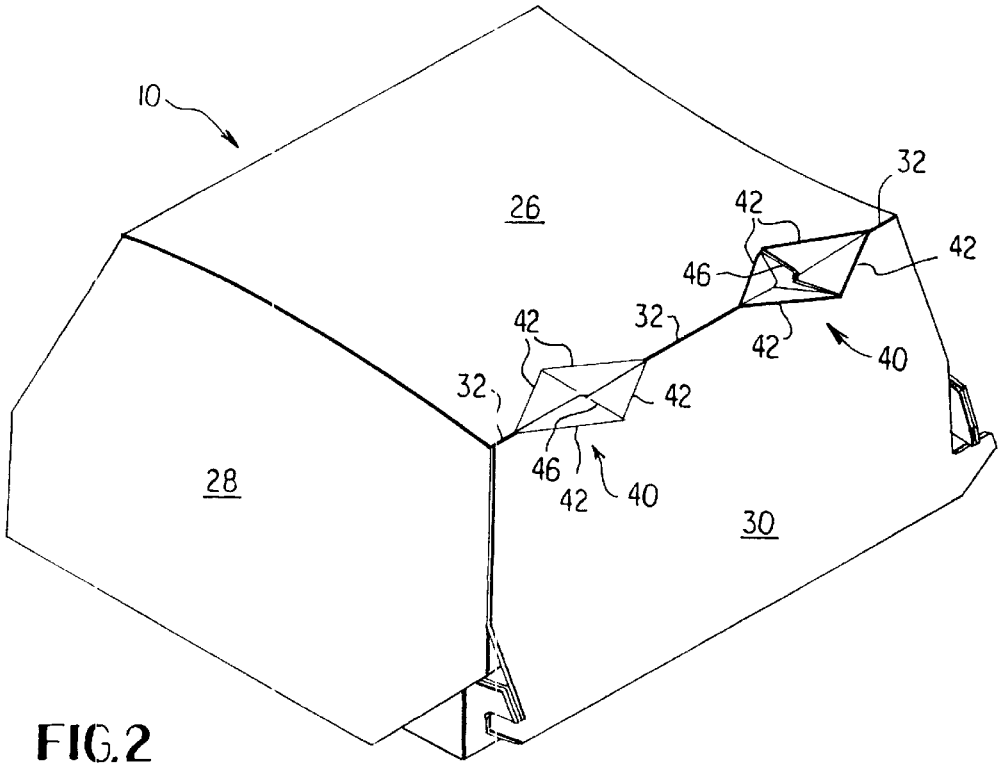
FIG. 2 is a partial perspective view showing a paperboard clamshell type carton provided with two identification buttons of this invention, with one button having been depressed or actuated to assume a different configuration from its original configuration, and the other button not actuated.

Two indicator buttons 40 are illustrated at FIGS. 1 and 2, with FIG. 1 showing their respective configurations in the unfolded condition of the blank. Each button 40 includes a periphery defined by partially cut straight fold line 42, these lines forming a generally diamond shape. The ends of meeting lines 42 touch each other for optimum ease in actuation, or they may be slightly spaced apart. Front edge fold 32, which joins panels 26 and 30, substantially longitudinally bisects each diamond shaped indicator button 40. Fold lines 42 are cut about half way through the thickness of the paperboard, and extend from the outer surface of the container or carton toward the carton interior. Additionally, a cut line 46 extends completely through the paperboard and also bisects each diamond shaped button 40, but in a direction at right angles to fold line 32. It will be observed that each cut line 46 is generally in the shape of an elongated or oppositely stretched Z or S.

Figure 3:
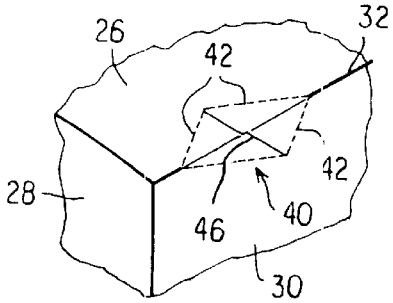
FIG. 3 is a partial view showing fold lines 42 of FIG. 2 in the form of perforated lines.

Turning now to FIG. 2, a clamshell carton has been formed from the blank of FIG. 1, by known operations of glueing and folding, and is shown in its latched or closed configuration. One of the diamond shaped indicator buttons 40 is shown as not actuated or not indented, while the other is shown as having been pushed inwardly towards the interior of the carton so that it more or less permanently assumes the depressed configuration indicated. Since the partial cuts of fold lines 42 extend from the outer towards the inner carton surfaces, it is relatively easy to inwardly bend, as by finger pressure, the two button half portions on either side of Z cut 46. It will be seen that the (actuated) Z shaped cut 46 defines a relatively narrow opening which will prevent the escape of significant quantities of heat and moisture from the interior of the carton due to the heated food product therein. Cut 46 may be straight or curved, but its preferable shape is that of an elongated Z to thereby limit its opened area, between opposite Z cuts, in the depressed configuration of the button. Optionally, fold lines 42 may be in the form of a series of small cuts extending completely through the paperboard and spaced from each other, as in the manner of perforated lines, as shown in FIG. 3. Fold lines 42 may also be in the form of bar score or crease lines. Z cuts 46 may also take the form of these latter two alternatives.

The indentation of any button, after pressing its center towards the container interior, is used as a visual indicator.

The non activated mode of one button 40 could indicate, for example, "No Cheese". The activated or indented mode of that one button could indicate "Cheese". An area near a button is typically provided with indicia either on front lid panel 30 or top panel 26.

While exhibiting special utility in the clamshell carton field, the invention is not so limited. Indicator buttons 40 may be used on any paperboard container having intersecting panels which define an edge, with the button(s) located so that this edge preferably longitudinally bisects the button (s), as shown at FIGS. 1 and 2. Buttons 40 may also be placed along any of fold lines 280 and 320.

While illustrated as diamond shaped for the preferred embodiment, the button(s) may be of other polygonal form as well as round or oval. It has been found that the identification buttons 40 function as intended when intersected by a edge of a paperboard carton or container, but do not function as described, or function poorly, when placed entirely within a flat surface of a container.

What is claimed is:

1. A paperboard carton construction of the type having a pair of intersecting, exterior panels whose intersection defines an edge of the container, a contents indicating button intersected by said edge, said button having a periphery defined by a plurality of fold lines each of which is partially cut through said intersecting paperboard panels, said button including a full cut line extending completely through said intersecting paperboard panels.

2. The carton of claim 1 wherein said fold lines are partially cut through an outer container surface towards an inner container surface.

3. The carton of claim 1 wherein said full cut line is Z-shaped.

4. The carton of claim 1 wherein said button is diamond shaped.

5. The carton of claim 1 wherein said button is substantially longitudinally bisected by said edge.

6. The carton of claim 1 wherein said fold lines are defined by a series of small cuts extending completely through said paperboard.

7. The carton of claim 1 wherein said fold lines are in the form of a bar score or crease lines.

8. The carton of claim 1 wherein said full cut line substantially bisects said button.

9. The carton of claim 1 wherein said full cut line is substantially at right angles to said edge.

* * * * *